US005147194A

United States Patent [19]

Kuhn et al.

[11] Patent Number: 5,147,194

[45] Date of Patent: Sep. 15, 1992

[54] ROTARY PISTON MACHINE WITH A PROTUBERANCE IN THE CYLINDER WALL

[75] Inventors: Peter Kuhn, Weinheim, Fed. Rep. of Germany; Frank Obrist, Dornbirn, Austria

[73] Assignee: TES Wankel Technische Forschungs-und Entwicklungsstelle Lindau GmbH, Lindau, Fed. Rep. of Germany

[21] Appl. No.: 796,050

[22] Filed: Nov. 20, 1991

[30] Foreign Application Priority Data

Dec. 28, 1990 [CH] Switzerland ..... 04139/90

[51] Int. Cl.[5] ..... F04C 2/24

[52] U.S. Cl. ..... 418/125; 418/126; 418/168

[58] Field of Search ..... 418/161, 164, 165, 166, 418/167, 168, 125, 126, 140

[56] References Cited

U.S. PATENT DOCUMENTS 1,993,721 3/1935 Pigott ..... 418/140
2,902,980 9/1959 Barrett ..... 418/125
3,652,191 3/1972 King et al. ..... 418/125
4,714,417 12/1987 Wankel ..... 418/166

FOREIGN PATENT DOCUMENTS 3219757 12/1983 Fed. Rep. of Germany ..... 418/125
58-51286 3/1983 Japan ..... 418/126

*Primary Examiner*—Richard A. Bertsch
*Assistant Examiner*—David L. Cavanaugh
*Attorney, Agent, or Firm*—Ladas & Parry

[57] ABSTRACT

For improving the gap sealing between the circumferential surfaces of rotors of a rotary piston machine and circular cylindrical inner surfaces (9) of the surrounding casing, rib-like protuberances (11) are displaced from the casing inner surfaces by cold working. On running in the rotary piston machine the external cross-sectional area of the protuberances (11) is removed by wear, so that between the protruberance (11) and the inner surface (9) a minimum sealing gap is obtained without corresponding manufacturing costs being involved in the formation thereof.

9 Claims, 7 Drawing Sheets

ROTARY PISTON MACHINE WITH A PROTUBERANCE IN THE CYLINDER WALL

BACKGROUND OF THE INVENTION

The invention relates to a rotary piston machine with rotors enclosed in a common casing and rotatable about fixed shafts, surfaces of the outer circumference of at least one of the rotors performing their rotary movement about one of the shafts with sealing gap-forming spacing along at least one cylindrical inner surface of the casing.

The efficiency of such machines, e.g. in compressing a gaseous medium, is largely determined by the quality of the seal of the rotors with respect to the surrounding casing. In order to obtain narrow sealing gaps, the casing, the rotors and their bearings must be manufactured and assembled with high precision, which leads to correspondingly high manufacturing costs.

A further complicating factor is that under the influence of centrifugal force and the operating temperature, the rotors assume a larger diameter and the casing suffers from thermal distortion.

The prior art sealing gap dimensioning was directed, in the case of maximum speed and the least favourable temperature distribution, at leaving a residual gap at all points such as is necessary in order to reliably prevent any risk of large-surface contact and the resulting seizing of the rotors at the high speeds which occur of e.g. 40 m/s and higher.

The very considerable difficulties in on the one hand determining and taking account of size changes or distortions and on the other hand the need for a residual gap under all conditions, have led to sealing gaps, which are wider than are absolutely necessary.

The problem of the invention, in connection with a machine of the aforementioned type, is to so improve the sealing of the circumferential surface of a rotor with respect to the casing inner surface, that the machine can be manufactured with relatively limited costs, that the minimum sealing gap width is obtained and that the risk of the rotor seizing is eliminated.

SUMMARY OF THE INVENTION

According to the invention this problem is solved in that on the inner surface of the casing is provided at least one rib-like protuberance shaped out of the casing material, so that between the said protuberance and the circumferential surface of the rotor a sealing gap is formed and that prior to the first putting into operation of the machine, said sealing gap is made narrower than would be possible for a contact-free operation in the entire speed and temperature range.

In operation, the circumferential surface of the rotor approaches the tip of the rib-like protuberance with increasing speed and rotor temperature and is finally removed by wear or through running in. Thus, only on running in the machine does the rib-like protuberance assume its final shape and height. This ensures that the rib-like protuberance is at no point lower than is absolutely necessary for the free running of the rotor.

As a result of the very closely defined surface of the rib-like protuberance facing the circumferential surface of the rotor, on running in there is only a limited material removal with a correspondingly low transformation of energy, so that the risk of the rotor seizing in the casing is avoided.

The precision requirements on the machine parts are also not excessive in the case of the solution according to the invention, because it is merely a question of ensuring that contact occurs between the circumferential surface of the rotor and the rib-like protuberance in one of the operating states which occur.

When applying the invention, it is recommended that several sealing gap-forming, rib-like protuberances are provided on the cylindrical outer surface of the casing, preferably in the immediate vicinity of the control edges.

A rib-like protuberance can be produced very simply by cold working, in that a groove is formed on the inner surface of the casing by stamping using a cutting edge-like punch or dye or by rolling in using a cross-sectionally acute-angled roller, so that it occurs as a one or two-sided beaded edge of the groove as a result of plastic material displacement.

Further embodiments of the invention can be gathered from the dependent claims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENT

Figure 1:
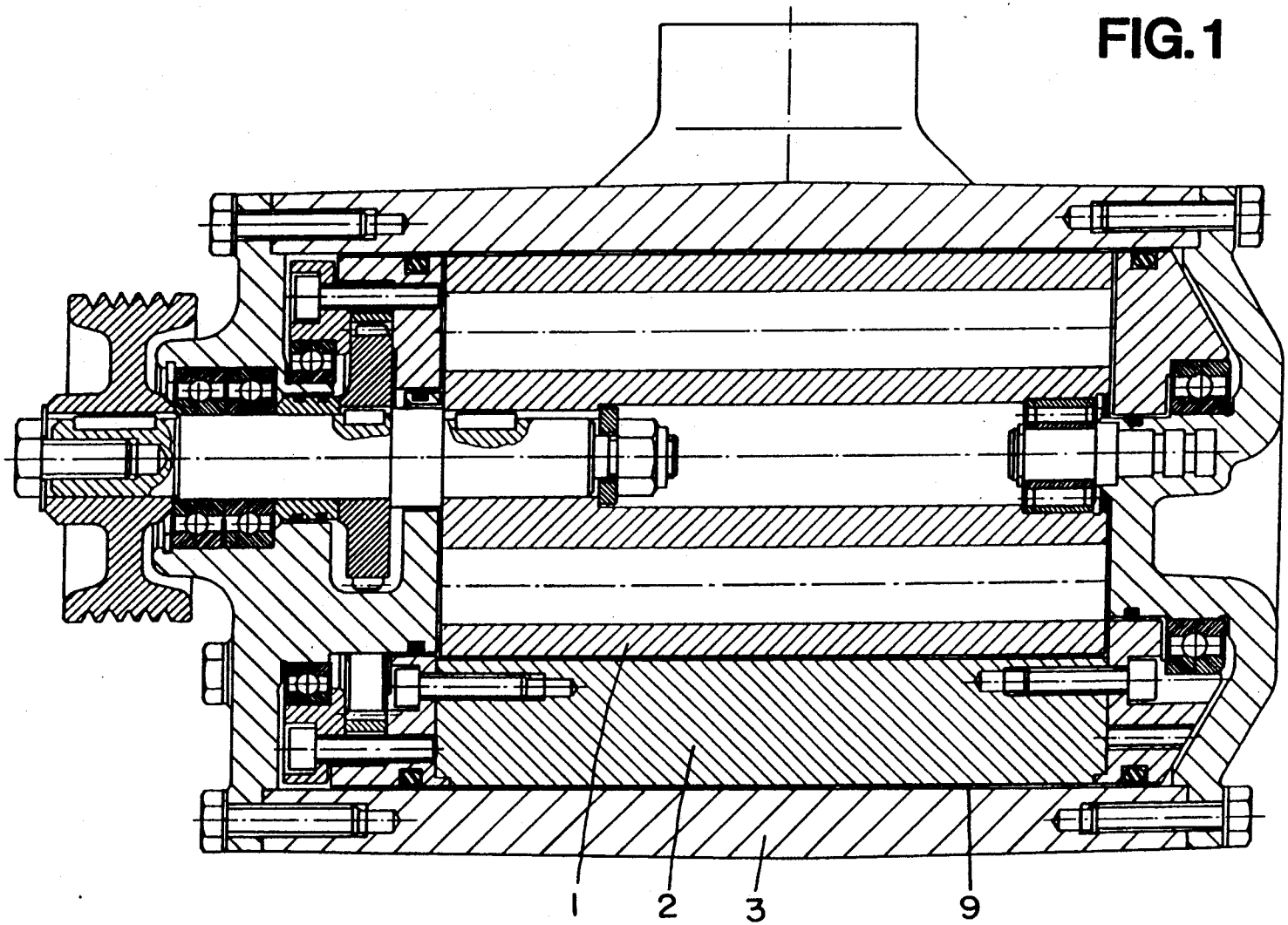
FIG. 1 A longitudinal section through an internal-shafted rotary piston machine in the plane containing the rotation axes of its rotors.
Figure 2:
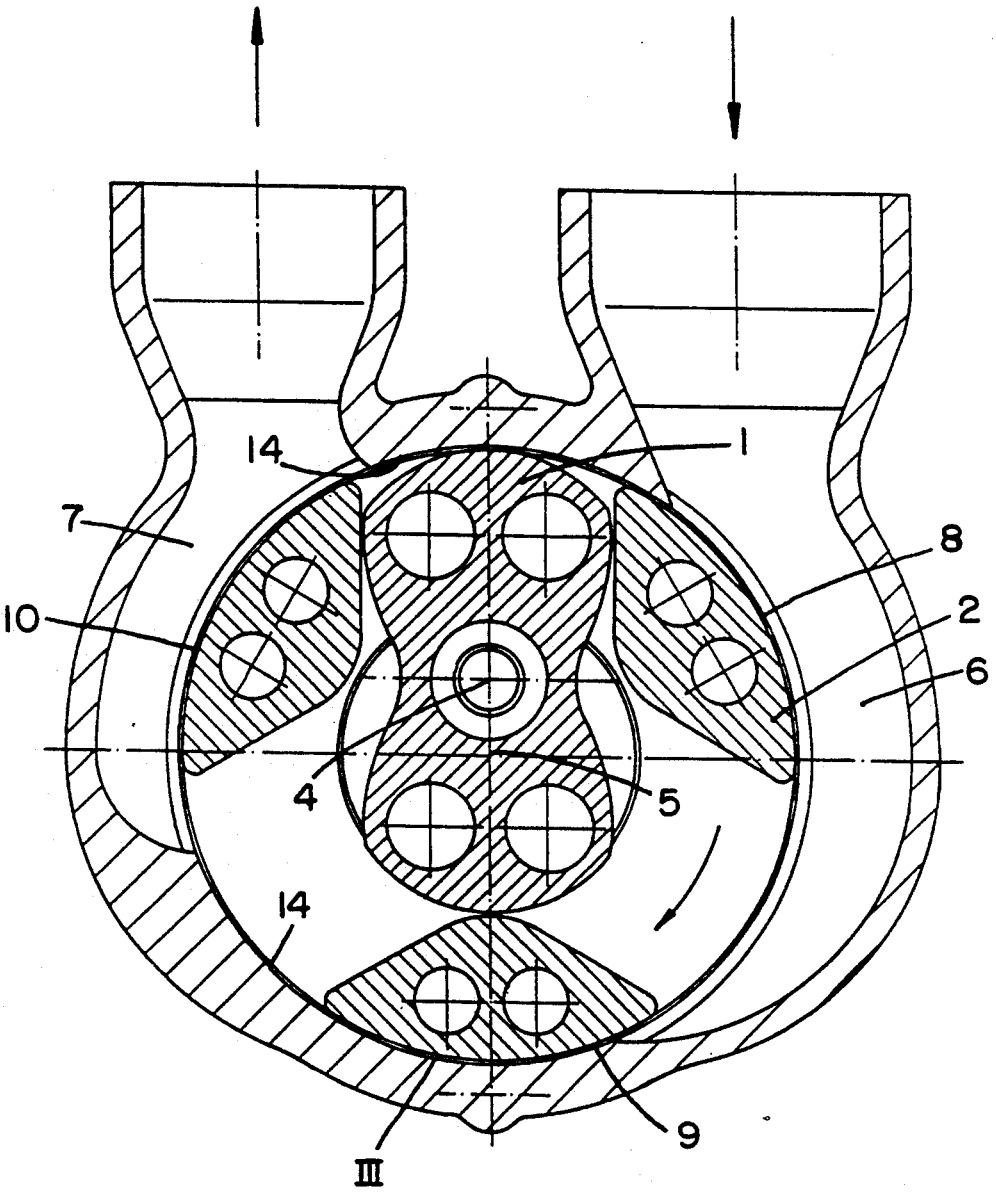
FIG. 2 A cross-section through the rotary piston machine of FIG. 1.

The internally shafted rotary piston machine shown in FIGS. 1 and 2, e.g. for compressing gaseous media, has the function known from DE-B-34 32 915 (U.S. Pat. No. 4,714,417). Its internal rotor 1 and external rotor 2 rotate about axes or shafts 4, 5, so that the circumferential surfaces of both rotors 1, 2 move on circular paths, as shown by the phase diagrams of FIG. 3 of the aforementioned patent specification.

For the sealing between the suction chamber 6 and the pressure chamber 7, the circumferential surfaces 8, 9, 10 of the external rotor 2 shaped in accordance with a circular cylindrical surface move in a constant, sealing gap-forming, small spacing along alternating areas of the circular cylindrical inner surface 14 of the casing 3.

The inventively essential rib-like protuberances 11, 16 are provided in certain areas of the cylindrical inner surface 14 of the casing 3 in order to improve the sealing action. They are not visible as a result of the scale used in FIGS. 1 and 2.

Figure 3:
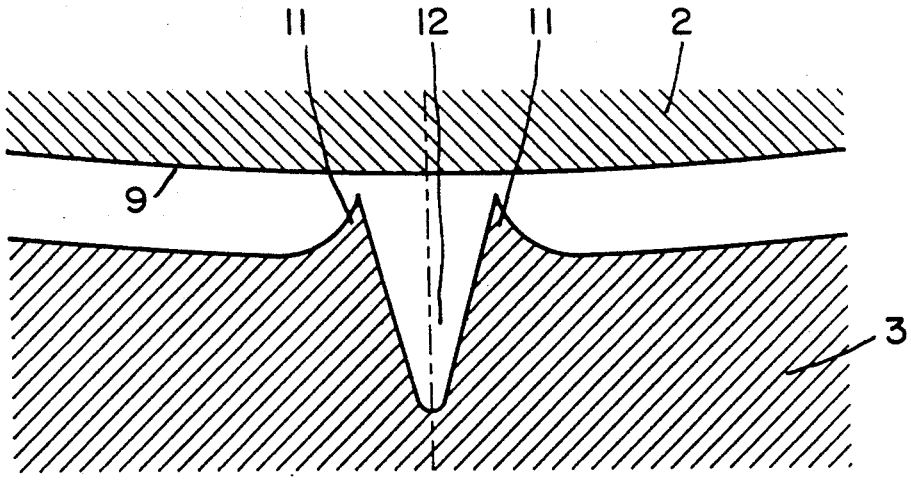
FIG. 3 A larger-scale detail in area III of FIG. 2.

FIG. 3 shows a larger-scale detail from FIG. 2 in the area of the gap between the circumferential surface 9 of the external rotor 2 and the inner surface 14 of the casing 3 with two of the inventive, rib-like protuberance 11 on either side of a rolled in groove 12 with the machine in the new state. The protuberances 11 or the groove 12 pass over the entire axial extension of the external rotor 2 shown in FIG. 1.

Figure 4:
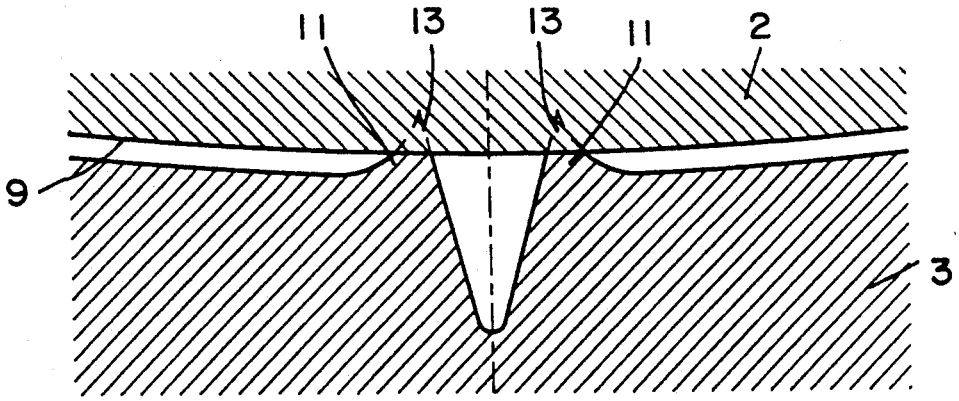
FIG. 4 The detail as in FIG. 3, but in the state of maximum approximation of the circumferential surface of the outer rotor to the inner surface of the casing.

FIG. 4 shows the same larger-scale detail as FIG. 3, but in the state of maximum approximation, as a result of centrifugal force and thermal expansion, of the circumferential surface 9 of the external rotor 2 to the inner surface 14 of the casing 3 or the rib-like protuberances 11. The broken lines 13 illustrate that up to the reaching of the represented state only a very small volume of material is removed by wear.

Figure 5:
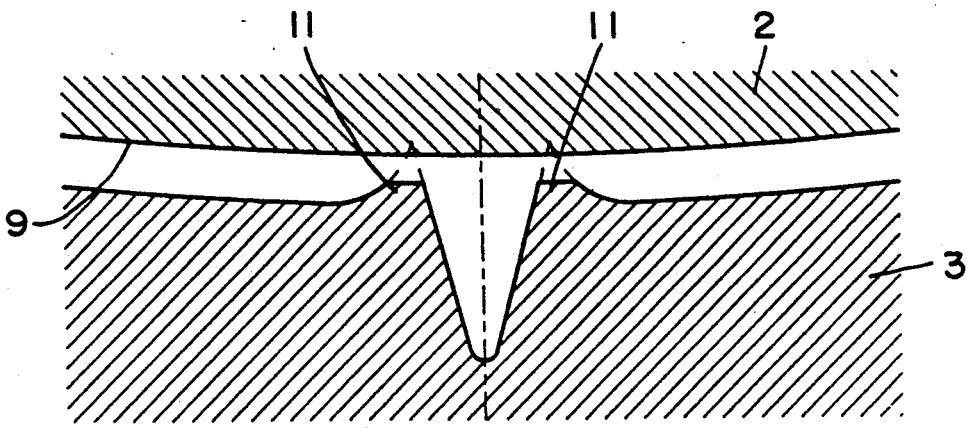
FIG. 5 The detail as in FIGS. 3 and 4 in the state of average approximation of the circumferential surface of the outer rotor to the inner surface of the casing.

FIG. 5 shows the same larger-scale detail as in FIG. 3, but in the state of average approximation of the circumferential surface 9 of the external rotor 2 to the protuberance 11. The sealing gap between the circumferential surface 9 and the protuberances 11 is no wider than is absolutely necessary for the free running of the external rotor 2 in the casing 3 when taking account of all the operating states. Therefore the sealing gap width is at a minimum.

Figure 6:
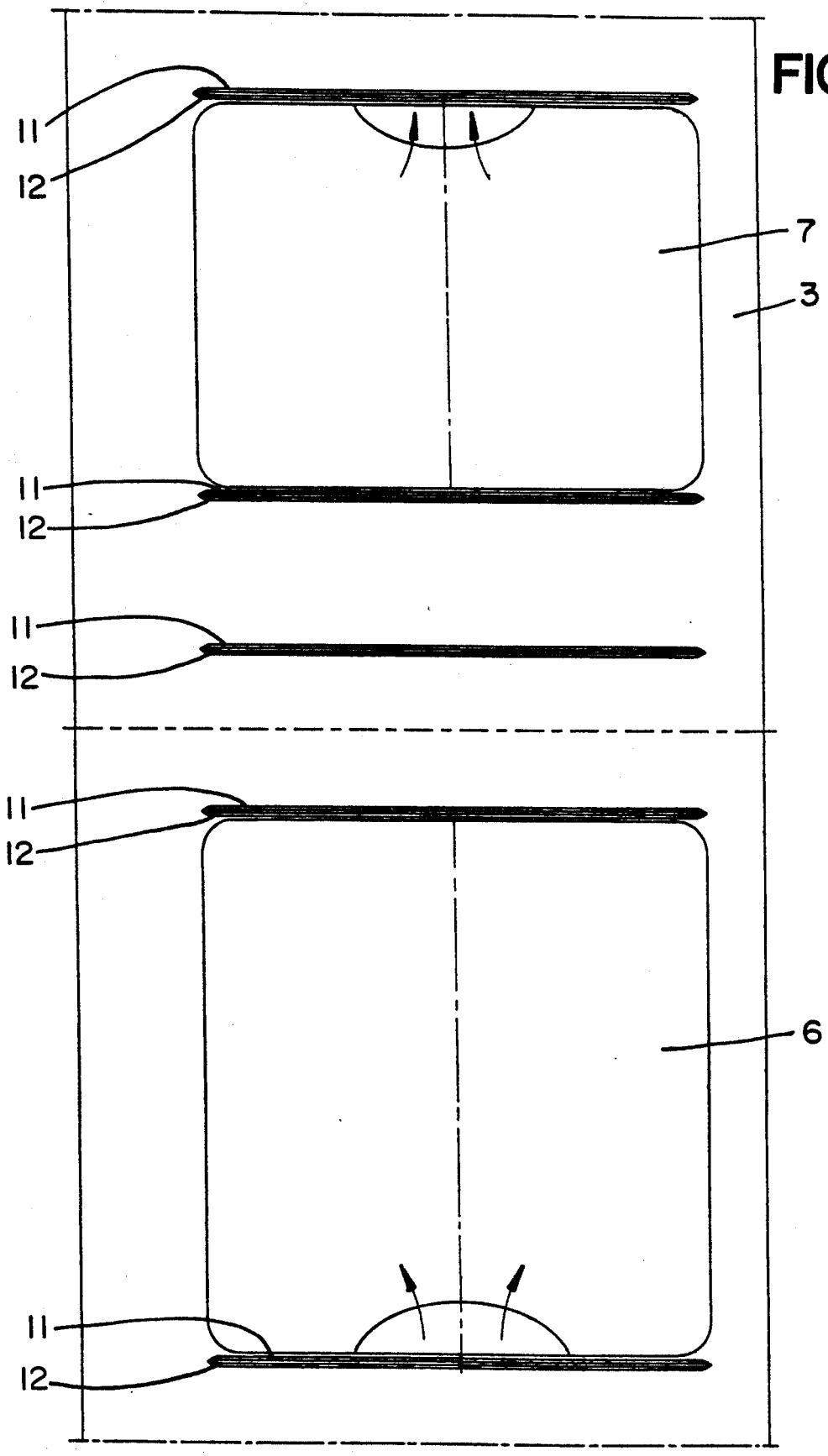
FIG. 6 The cylindrical inner surface of the casing developed in the plane.

FIG. 6 is a view of the cylindrical inner surface 14 of the casing 3 developed in the plane and having the suction chamber 6 and the pressure chamber 7. The connections are illustrated by arcs and the flow direction is indicated by arrows. As shown in cross-section in FIGS. 3 to 5 at five points on the circumference of the inner surface 14 of the casing 3 and in particular on the control edges are provided protuberances 11 or grooves 12. They seal the suction chamber 6 with respect to the pressure chamber 7 with the minimum gap width.

Figure 7:
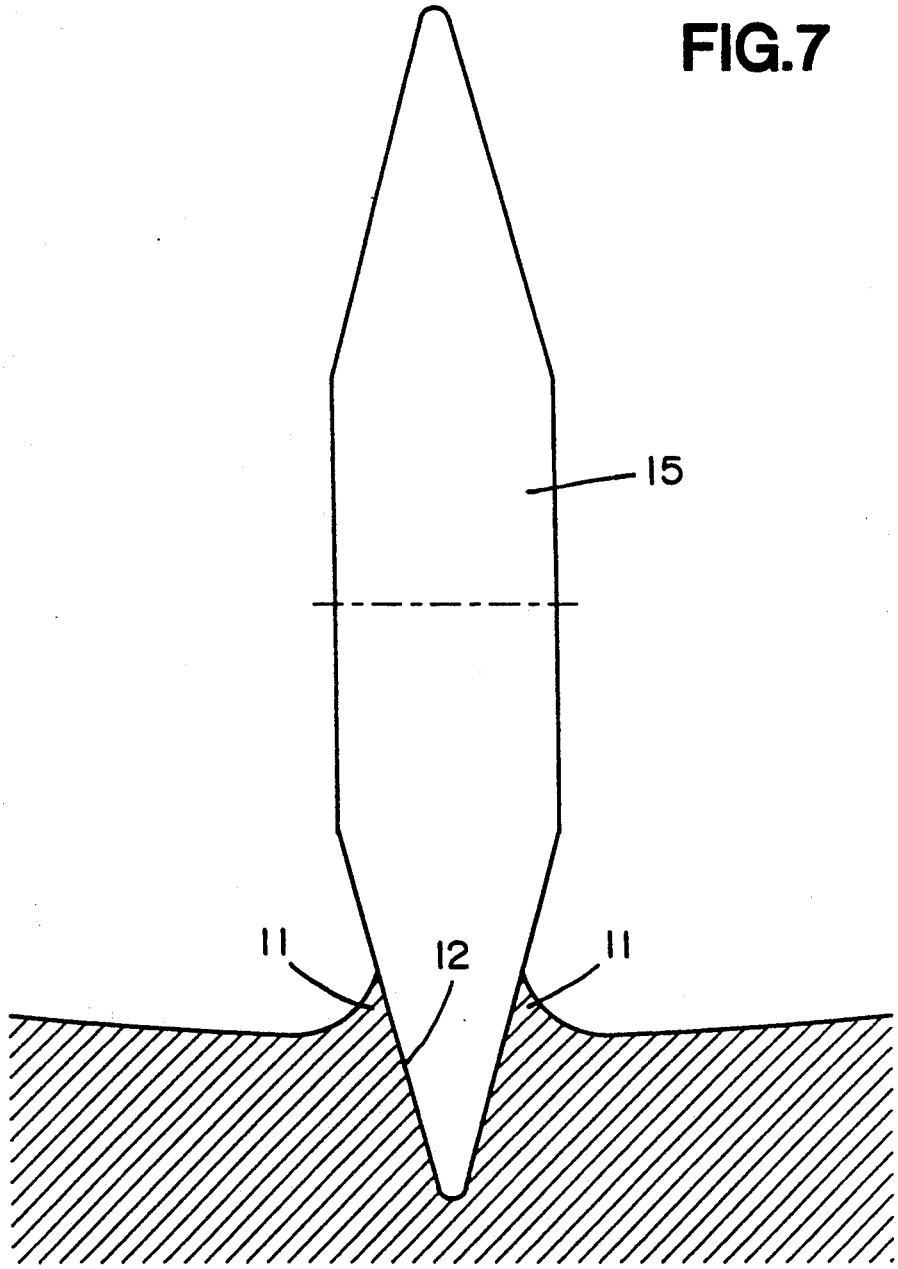
FIG. 7 A simplified representation of a tool for producing a pair of rib-like protuberances in the working position.
Figure 8:
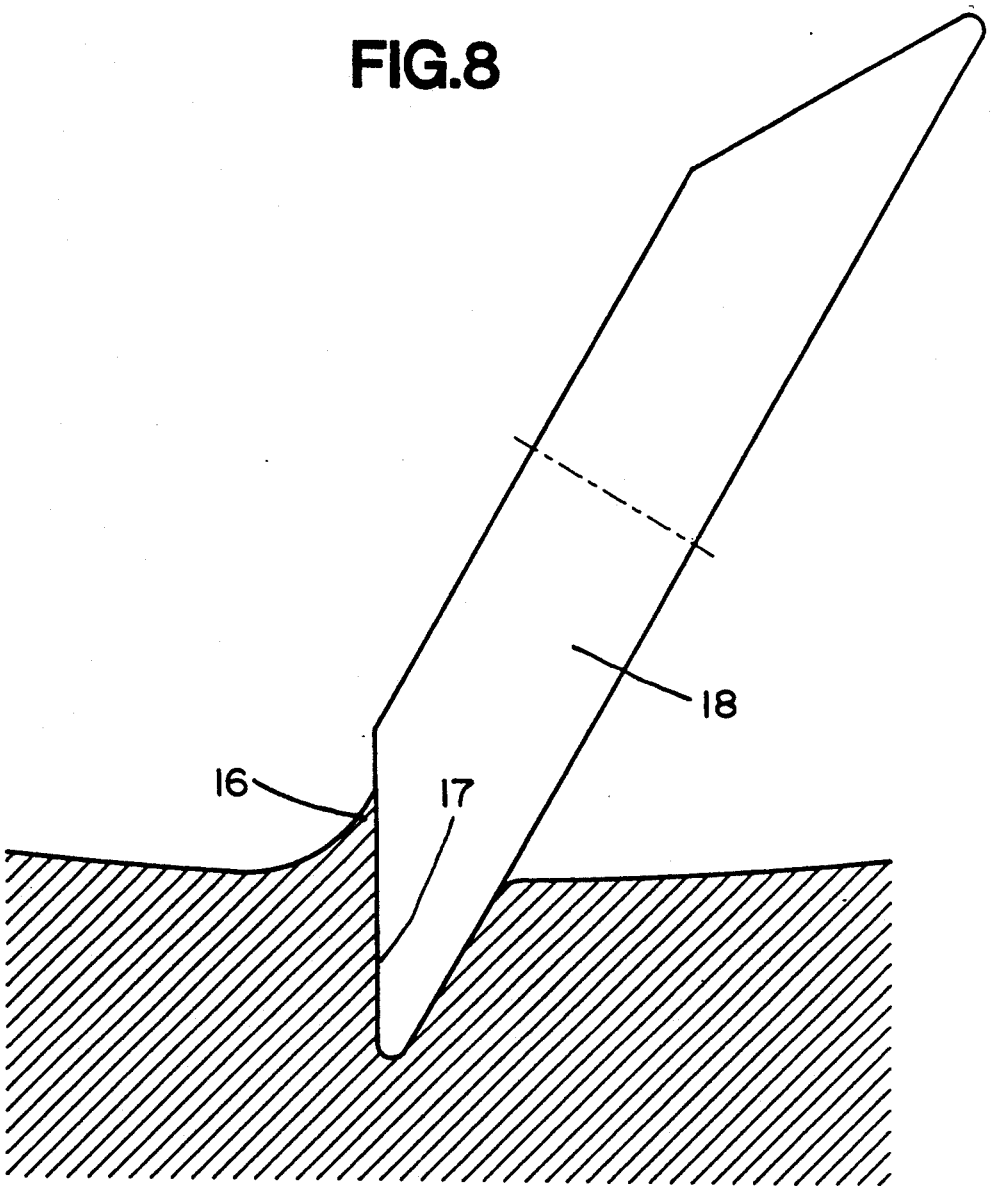
FIG. 8 A simplified representation of a tool for producing a rib-like protuberance in the working position.
Figure 9:
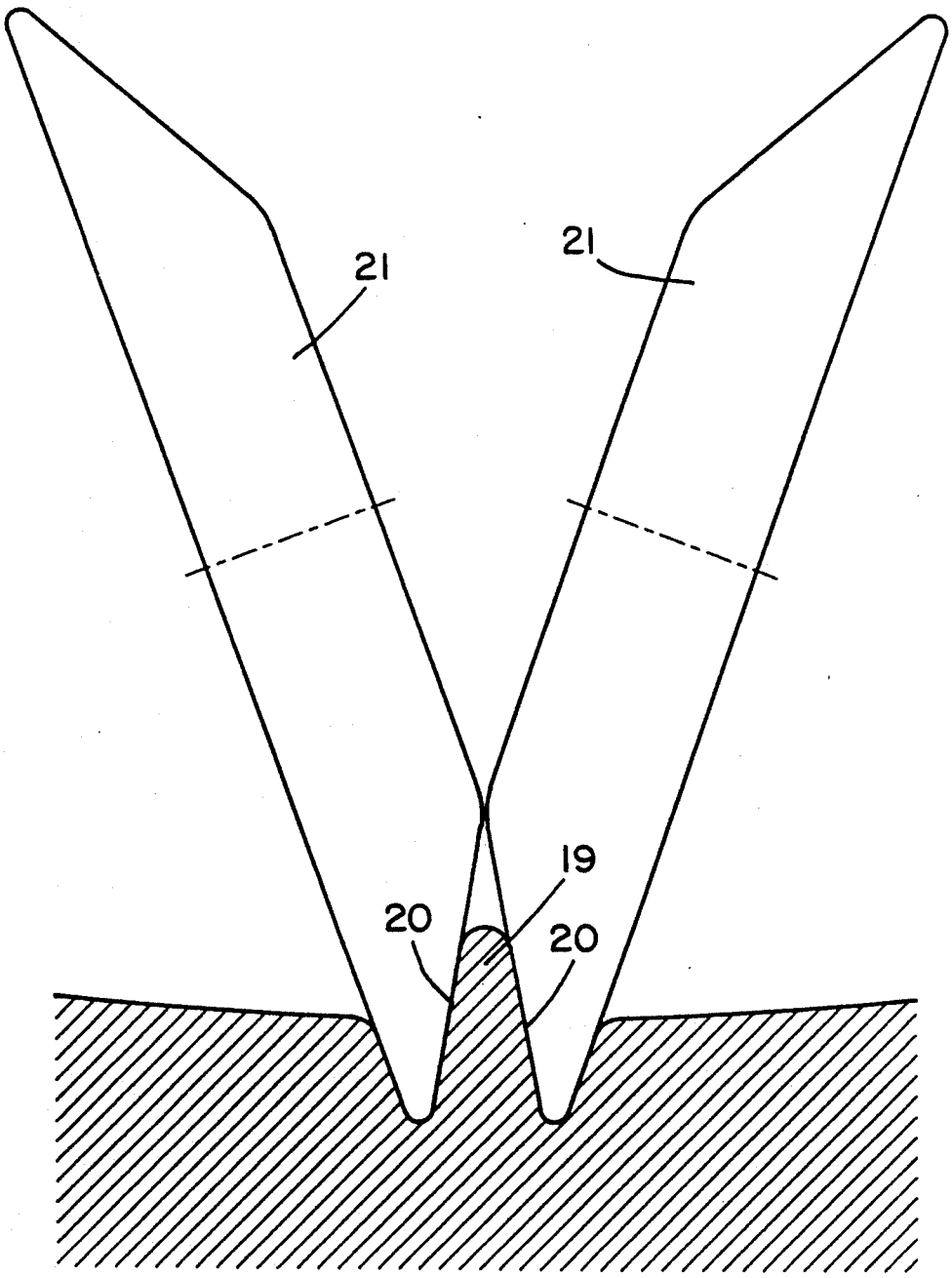
FIG. 9 A simplified representation of a pair of tools for producing a rib-like protuberance in the working position.

FIGS. 7, 8 and 9 illustrate how the sealing gap-forming protuberances are obtained by material displacement, in that the material squeezed out of one or two grooves forms a bead or flange-like bulge of the groove edges.

FIG. 7 e.g. shows the formation of the groove 12 shown in FIG. 3 with the rib-like protuberances 11 on either side by rolling in using a roller 15.

FIG. 8 illustrates the formation of a single rib-like protuberance 16 on one side of a groove 17 by rolling in with an inclined, profiled roller 18.

Finally, FIG. 9 shows the formation of a rib-like protuberance 19 between two grooves 20, which are produced by two inclined rollers 21.

What is claimed is:

1. A rotary piston machine with rotors (1, 2) enclosed in a common casing (3) and rotatable about fixed shafts (4, 5), surfaces (8–10) of the outer circumference of at least one of the rotors (1, 2) performing their rotary movement around one of the shafts (4, 5) with a sealing gap-forming spacing along the inner surfaces (14) of the casing (3), wherein on the inner surface (14) of the casing (3) is provided at least one rib-like protuberance (11, 16, 19) shaped out of the casing material, so that between the said protuberance (11, 16, 19) and the circumference (8–10) of the rotor (1, 2) a sealing gap is formed and that prior to the first putting into operation of the machine said sealing gap is made narrower than would be possible for the contact-free operation in the entire speed and temperature range.

2. A rotary piston machine according to claim 1, wherein parallel and adjacent to the rib-like protuberance (11, 16, 19) is provided at least one groove (12, 17, 20), which forms a depression in the casing surface.

3. A rotary piston machine according to claim 1, wherein at least one of the longitudinal side boudary surfaces of the rib-like protuberance (11, 16, 19) continues without a step into a groove (12, 17, 20).

4. A rotary piston machine according to claim 1, wherein a groove (20) runs alongside both longitudinal sides of the rib-like protuberance (19).

5. A rotary piston machine according to claim 1, wherein two facing, parallel rib-like protuberances (11) enclose between them a groove (12).

6. A rotary piston machine according to claim 2, wherein the protuberance (11, 16, 19) and the groove (12, 17, 20) are formed by material displacement, in that the protuberance is at least partly formed from material which is displaced from the groove.

7. A rotary piston machine according to claim 1, wherein in each case one rib-like protuberance of the casing inner surface is located on the control edges of the casing.

8. A rotary piston machine according to claim 1, wherein several rib-like protuberances (11, 16, 19) at right angles to the movement direction of the rotor (2) are distributed in said movement direction on one of the inner surfaces (14) of the casing (3) along which moves a circumferential surface (8–10) of a rotor (2).

9. A rotary piston machine according to claim 1, wherein the protuberance (11, 16, 19) has a height of less than 0.2 mm with respect to the surface (14), in which it is provided as a surface profiling.

* * * * *